United States Patent [19]

Hines

[11] Patent Number: 4,976,037

[45] Date of Patent: Dec. 11, 1990

[54] MARKING AND CUTTING DEVICE

[76] Inventor: Burl D. Hines, P.O. Box 560, Plain Dealing, La. 71064

[21] Appl. No.: 284,404

[22] Filed: Dec. 14, 1988

Related U.S. Application Data

[63] Continuation-in-part of Ser. No. 170,849, Mar. 21, 1988, abandoned.

[51] Int. Cl.[5] ..... B43L 9/04

[52] U.S. Cl. ..... 33/27.03; 33/769; 33/759; 33/668

[58] Field of Search ..... 33/27.03, 759, 760, 33/761, 668, 769

[56] References Cited

U.S. PATENT DOCUMENTS

| | | | |
|---|---|---|---|
| 491,715 | 2/1893 | Mondor | 33/138 |
| 966,473 | 8/1910 | Richardson . | |
| 2,065,143 | 12/1936 | Metcalf . | |
| 2,349,670 | 5/1944 | Moxey . | |
| 2,400,343 | 5/1946 | Eskil . | |
| 2,473,189 | 6/1949 | Baker | 33/761 |
| 2,581,858 | 1/1952 | Hilt et al. | 33/27.03 |
| 2,582,488 | 1/1952 | Kroenlein | 33/27.03 |
| 2,621,409 | 12/1952 | Dvorak . | |
| 2,906,024 | 9/1959 | Smith . | |
| 3,035,352 | 5/1962 | Pope . | |
| 3,036,791 | 5/1962 | Siggelkow | 33/758 X |
| 3,292,262 | 12/1966 | Moll | 33/27.03 |
| 3,393,454 | 7/1968 | Creighton . | |
| 3,797,118 | 3/1974 | Yamamoto . | |
| 4,023,277 | 5/1977 | Fizer . | |
| 4,103,426 | 8/1978 | Robin . | |

*Primary Examiner*—Harry N. Haroian
*Attorney, Agent, or Firm*—John M. Harrison

[57] ABSTRACT

A combination marking and cutting device which is characterized by a cylindrical, hollow handle having a removable plug at one end and a tape housing provided on the opposite end, for receiving a length of spring-loaded measuring tape. The measuring tape can be extended from the tape housing against spring tension and is fitted with a retainer on the end thereof, for receiving a scribing instrument, pencil or a knife blade and inscribing, pencil marking or cutting various geometric patterns in a workstock. A tape lock is provided in the tape housing for locking the tape at a selected length to facilitate use of the tool combination as a compass, marking and/or cutting tool.

6 Claims, 1 Drawing Sheet

1
2
4
5
6
9
11
13
15
16
19
21
22
23
24
25
26
35
36
37
38
39
40
41
42
44
45
46
50
52
53
54
56

3
7
8
10
13
14
15
16
17
18
19
20
24
26
27
30
31
32
33
34

2
4
5
11
13
14
16
19
21
26
27
32
33
36
37
38
39
41
42
43
44
45

2
4
5
6
9
11
13
14
16
19
21
24
26
28
29
35
36
41
42
43
44
45

46
47
48
48a
49
50
50b
51
52
53
54
55
56

MARKING AND CUTTING DEVICE

BACKGROUND OF THE INVENTION

CROSS-REFERENCE TO RELATED APPLICATIONS:

This application is a Continuation-In-Part of my copending Patent Application, Ser. No. 07/170,849, dated March 21, 1988, entitled "Combination Compass, Marking and Cutting Device" now abandoned.

FIELD OF THE INVENTION

This invention relates to beam compasses and similar instruments and more particularly, to a marking and cutting device which is characterized by a hollow, offset handle provided with a removable plug at one end and a tape housing at the opposite end, which tape housing is fitted with a length of spring-loaded measuring tape The measuring tape is rolled on a spring-biased axle or spool rotatably mounted in the tape housing and extends from a slot provided in the housing and is further fitted with a retainer at the extending end thereof for selectively receiving pencil or a scribing or cutting instrument for inscribing, otherwise marking, or cutting geometric patterns. The pencil, scribing and cutting instruments can be stored in the hollow interior located in the handle of the marking and cutting device by removing the plug when the device is not in use.

One of the problems realized in carpentry and other construction trades is that of inscribing, marking and cutting various geometric patterns, including straight lines, in such materials as plywood, sheetrock or gypsum board, formica and similar materials. Even such simple tasks as marking and cutting plywood to a selected width usually requires that the carpenter extend a conventional measuring tape from the tape housing, lock the tape at a selected length and slide the tape housing along the edge of the plywood, with the opposite end of the tape held in the other hand along with a scribe or pencil, to inscribe or pencil mark a line of selected length on the plywood sheet. This technique is also often used to mark or cut sheetrock or gypsum board, as well as formica, and frequently results in splinters and slicing injuries to the fingers or hand holding the tape housing. Circles are also difficult to inscribe, pencil mark or cut using a conventional tape, due to the difficulty of holding the tape housing precisely in the center of the circle at a specific location and inscribing, pencil marking or cutting the circle by holding a scribe, pencil or knife, respectively, and the opposite end of the tape at a selected radius.

Accordingly, it is an object of this invention to provide a marking and cutting device which is characterized by a hollow handle provided with a plug or closure at one end and a tape housing at the opposite end, wherein the handle is offset from the centerline of the tape housing, which tape housing encloses a length of wound, spring-loaded tape that may be extended from the housing and is provided with a retainer at one end for releasably receiving a scribing instrument such as a scratch awl, pencil or knife blade and inscribing, pencil marking or cutting a selected geometric pattern on a workstock.

Another object of the invention is to provide a combination marking and cutting device for inscribing, marking and cutting straight lines, as well as various selected curved geometric patterns, which device is characterized by a hollow handle fitted with closure or plug at one end for receiving and storing various accessory items such as knife blades and pencils for use with the device. A hollow tape housing is provided on the opposite end of the handle in offset relationship with respect to the handle for receiving a spring-loaded tape having a retainer fitted to the extending end thereof, such that a scratch awl shaft, pencil or knife blade can be placed in the retainer, the tape extended to a selected length and the device used to inscribe, pencil mark, or cut straight lines and desired curved geometrical patterns on a piece of material such as plywood, sheetrock or gypsum board and formica, in non-exclusive particular.

Yet another object of the invention is to provide a marking and cutting device which includes a hollow handle fitted with a removable, threaded plug at one end and an offset tape housing at the opposite end, a spring-loaded tape coiled on a rotatable spring-loaded spool located in the tape housing, with one end of the tape extended from a tape slot provided in the tape housing and fitted with a retainer for receiving a scribe, knife blade or a pencil, with a tape locking mechanism provided in the housing for selectively engaging and locking the tape at a selected extension distance and utilizing the housing as a fulcrum point for inscribing, cutting or otherwise marking circles and areas on various materials to be marked or cut.

SUMMARY OF THE INVENTION

These and other objects of the invention are provided in a new and improved combination marking and cutting device which includes a generally cylindrically-shaped, hollow housing provided with a removable plug at one end and a tape housing at the opposite end, which handle projects from the tape housing in angular relationship, with a spring-loaded measuring tape wound on a spool provided with a coil spring rotatably mounted located inside the housing, the tape having one end extending through a slot in the housing and receiving a retainer therein, which retainer is designed to removably engage and seat a scribing instrument such as a scratch awl shaft, a pencil or a knife blade for scribing, cutting or pencil marking various geometrical patterns, including circles and straight lines, on building materials and a workstock.

BRIEF DESCRIPTION OF THE DRAWING

The invention will be better understood by reference to the accompanying drawing, wherein.

DESCRIPTION OF THE PREFERRED EMBODIMENTS

Figure 1:
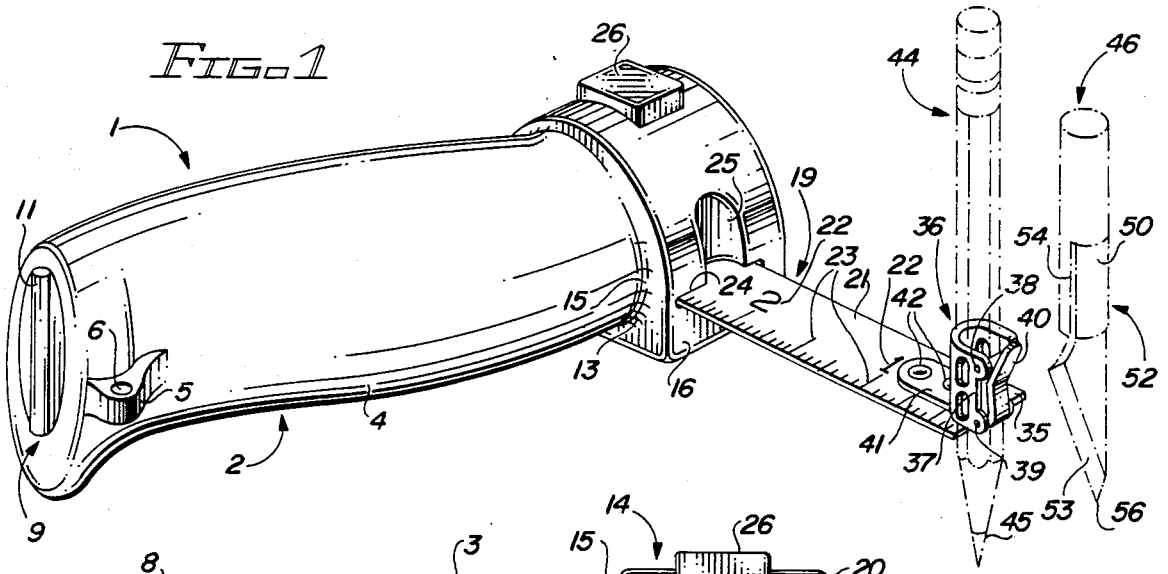
FIG. 1 is a perspective view of a preferred embodiment of the marking and cutting device of this invention.
Figure 2:
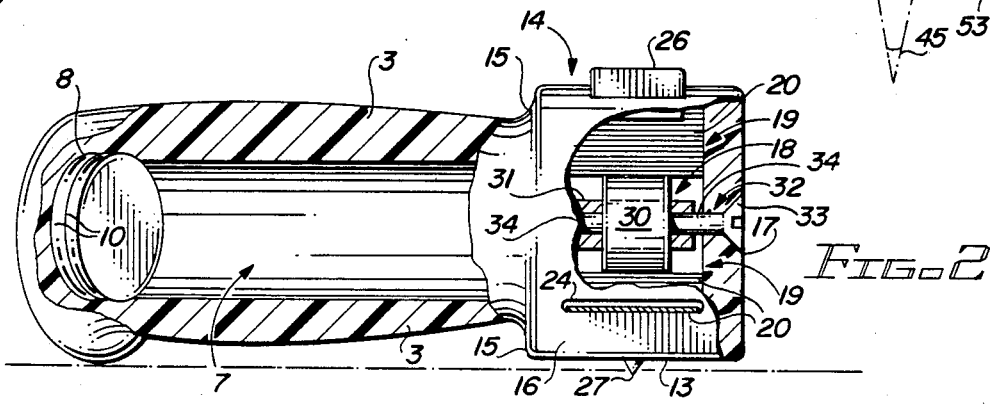
FIG. 2 is a longitudinal sectional view of the marking and cutting device illustrated in FIG. 1.

Referring initially to FIGS. 1 and 2 of the drawing, the combination compass, marking and cutting device of this invention is generally illustrated by reference numeral 1. The marking and cutting device 1 is characterized by a generally cylindrically-shaped handle 2, provided with a central handle bore 7 in the interior thereof which handle bore 7 is defined by a handle side wall 3. In a preferred embodiment of the invention, a curved handle grip 4 is provided on the underside of the handle 2, in order to facilitate fitting a user's hand while the marking and cutting device 1 is being used. In another preferred embodiment, a lanyard flange 5 is provided at the heel or rear area of the handle grip 4 and a flange opening 6 extends through the lanyard flange 5, in order to receive a lanyard (not illustrated) for suspending the marking and cutting device 1 from the neck of a workman or from a tool belt (not illustrated), as desired. As further illustrated in FIG. 2, the rear or heel end of the handle 2 is fitted with internal threads 8, which are designed to match the external plug threads 10 of a removable plug 9, in order to gain access to the handle bore 7. A plug grip 11 is also provided in the plug 9 to facilitate grasping the plug 9 and removing or replacing the plug 9 from or in the handle 2, respectively. As further illustrated in FIG. 2, the handle bore 7 extends through the approximate center of the handle 2, from the plug 9 to the handle end wall 12.

As further illustrated in FIGS. 1 and 2, a tape housing 14 is disposed on the opposite end of the handle 2 from the plug 9 in angular relationship, for receiving the coiled tape segment 20 of a measuring tape 19, as particularly illustrated in FIG. 2. The enlarged tape housing 14 is characterized by a flat base 13 and a rounded housing shoulder 15, which extends from the outside surface of the handle side wall 3 to the exterior surface of the flat housing side wall 16, and a flat housing end wall 17 terminates the tape housing 14, as illustrated. The tape housing 14 is further characterized by a hollow interior 18, which is designed to receive the coiled tape segment 20 of a length of measuring tape 19, while an extended tape segment 21 of the measuring tape 19 extends from the coiled tape segment 20 through a tape slot 24, provided in the housing side wall 16, as further illustrated in FIG. 1. In a most preferred embodiment of the invention, a curved housing recess 25 is molded or otherwise provided in the housing side wall 16 adjacent to and above the tape slot 24, in order to receive a retainer 36 in recessed fashion, which retainer 36 is secured to the extending end of the extended tape segment 21, further as illustrated in FIG. 1. The measuring tape 19 is further characterized by conventional numerals 22 and markings 23, which facilitate measuring the distance between the tape slot 24 of the tape housing 14 and an object spaced from the tape housing 14. The handle 2 curves outwardly from the tape housing 14, in order to facilitate grasping the handle 2, aligning the housing side wall 16 with a sheet of panel (not illustrated) to be marked and sliding the marking and cutting device 1 along the panel without injuring the user's fingers.

As further illustrated in FIG. 2, in a most preferred embodiment of the invention the coiled tape segment 20 of the measuring tape 19 is tightly wound on a coil spring 30, mounted on a spool 31, located inside the hollow interior of the tape housing 14. In another preferred embodiment, an axle mount bolt 32 extends through the hollow spool 31 and threadably seats in the tape housing 14, to removably secure the spool 31, the coil spring 30 and the coiled tape segment 20 of the measuring tape 19, in rotatable orientation inside the hollow interior 18. The axle mount bolt 32 is typically characterized by an elongated shank 34, provided with threads (not illustrated) at one end and a slotted head 33 at the opposite end to facilitate removal of the spool mount bolt 32 from the tape housing 14.

Referring again to FIG. 1, a selected extension of the extended tape segment 21 of the measuring tape 19 from the tape housing 14 is effected by manipulation of the tape lock 26, which selectively prevents further extension or retraction of the extended tape segment 21 to and from the tape housing 14. A fulcrum 27 is provided on the flat base 13 of the tape housing 14 as illustrated in FIG. 2, for inscribing a circle or an arc at a selected distance from the handle 2 and the tape housing 14 and marking or cutting sheets of panel workstock, such as plywood or gypsum board, as hereinafter further described.

Figure 3:
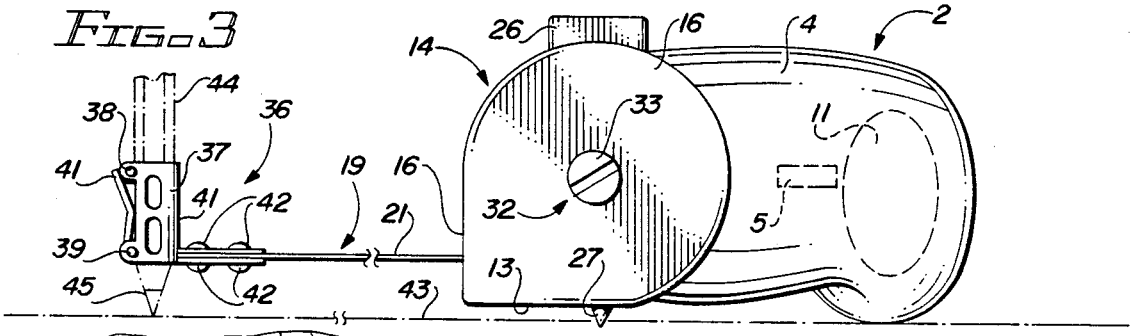
FIG. 3 is a front end view of the marking and cutting device illustrated in FIG. 1.

Referring now to FIGS. 1–3 of the drawing, in a most preferred embodiment of the invention the retainer 36 is further characterized by a U-shaped retainer bracket 37 which is vertically mounted to the extended tape segment 21 of the measuring tape 19 in recessed fashion at the tape end 35. As illustrated in FIG. 3, the retainer 36 is recessed in the tape end 35 in order that the pencil point 45 be aligned with the tape end 35, to facilitate accurate measurement according to the numerals 22 and markings 23 from the tape slot 24 to the pencil point 45. A top pin 3 is seated in and horizontally spans the open segment of the U-shaped retainer bracket 37. Similarly, a bottom pin 39 spans the bottom portion of the retainer bracket 37 in horizontal relationship and pivotally receives one end of a compression lever 40, such that pivotal extension of the compression lever 40 against the top pin 38 operates to secure a pencil 44 or a retainer handle 47, illustrated in phantom, in the retainer 36. An L-bracket 41 is provided with one leg secured to the retainer bracket 37 and the opposite leg lying adjacent the top surface of the extended tape segment 21 near the tape end 35 thereof and pair of spaced brads 42 extend through the extended tape segment 21 and the opposite leg of the L-bracket 41, to secure the L-bracket 41 to the extended tape segment 21, as illustrated. Accordingly, as further illustrated in FIGS. 1 and 3, a pencil 44, illustrated in phantom, can be inserted in the U-shaped opening in the retainer bracket 37 when the compression lever 40 is downwardly pivoted on the bottom pin 39 away from the top pin 38 and the compression lever 40 is then pivoted upwardly against the top pin 38 to engage the pencil 44 and secure the pencil 44 in the retainer 36 with the pencil point 45 facing downwardly.

Figure 5:
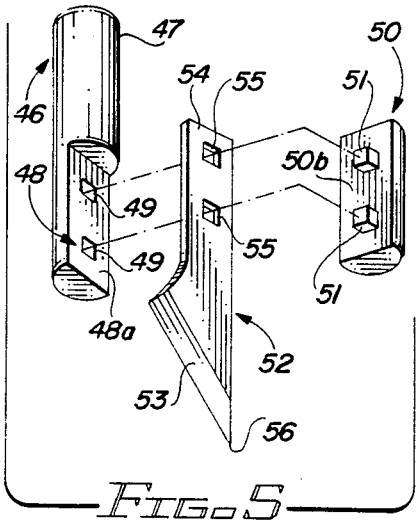
FIG. 5 is an exploded view of a preferred knife blade handle for removably receiving a knife blade and fitting in the retainer of the marking and cutting device illustrated in FIGS. 1–4.

Referring now to FIGS. 1 and 5 of the drawing, a knife blade handle 46 is characterized by a retainer handle 47 having a diameter approximately equal to the diameter of the pencil 44 and provided with a handle slot 48 extending to the bottom end thereof. A pair of spaced detent seats 49 are provided in the flat slot face **48*a* of the handle slot 48, in order to receive a pair of corresponding detents 51, projecting from the flat keeper face 50*b* of a keeper 50, which keeper face 50*b* matches the slot face 48*a* in the handle slot 48, as further illustrated in FIG. 5. The detents 51 are designed to register with corresponding spaced shank openings 55, located the blade shank 54 of the knife blade 52, in order to secure the knife blade 52 in the knife blade handle 46**, as further illustrated in phantom in FIG. 1. When the knife blade 52 is so secured the knife blade handle 46 can be mounted in the retainer 36 in the same manner as the pencil 44, illustrated in FIG. 1. The knife blade 52 is typically provided with a cutting edge 53, which tapers to a blade point 56, as illustrated in FIG. 1. Similarly, a scribing instrument such as the shaft of a scratch awl (not illustrated) or a similar instrument having a sharp point may be mounted in a handle such as the knife blade handle 46, illustrated in FIG. 5, and the scribing instrument used to mark a selected line or pattern.

Figure 4:
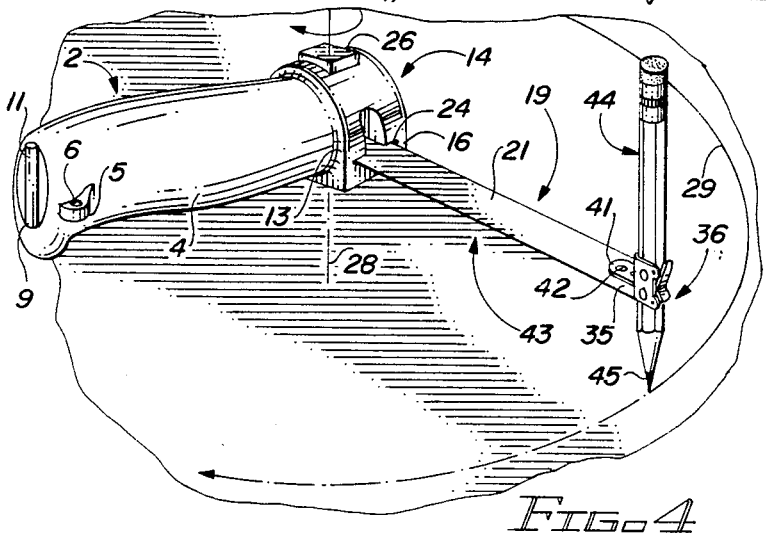
FIG. 4 is a perspective view of the marking and cutting device illustrated in FIG. 1, with the measuring tape extended to inscribe, pencil mark or cut an arc about a pivot point running vertically through the device housing.

Referring now to FIGS. 3 and 4 of the drawing, when it is desired to mark a line or a geometrical pattern such as the arc 29 on a workstock or workpiece 43, such as a sheet of plywood, formica or gypsum board, in non-exclusive particular, the marking and cutting device 1 is readied for use by initially placing the pencil 44 in the retainer 36 and locking it therein by manipulating the pivoted compression lever 40 upwardly, as heretofore described. A length of extended tape segment 21 of the measuring tape 19 is extended from the tape housing 14 against the bias of the coil spring 30 to a measured point from the location of the fulcrum 27, as determined by the numerals 22 and the markings 23, illustrated in FIG. 1. The pencil 44 is then grasped, the pencil point 45 placed on the workpiece 43 at the appropriate point and the arc 29 inscribed thereon with the marking and cutting device 1 pivoted about a fulcrum axis 28 which extends vertically through the tape housing 14 and the fulcrum 27, as illustrated in FIG. 4. Accordingly, the arc 29, or a circle inscribed by completing the arc 29, which circle (not illustrated) has a selected radius equal to the length of the extended tape segment 21, can be marked using the pencil 44. Similarly, if it is desired to cut an arc 29 or a circle from an arc 29 of selected radius using the knife 52, the knife 52 is first assembled in the retainer handle 47 as illustrated in FIGS. 1 and 5 and the knife blade handle 46 is then inserted in the retainer 36 and retained therein by manipulation of the compression lever 40, as heretofore described. The desired arc 29 or a circle of selected radius (not illustrated) can be then cut in the workpiece 43, by grasping the knife blade handle 46 and pivoting the marking and cutting device 1 on the fulcrum 27 about the fulcrum axis 28, as illustrated in FIG. 4.

It will be further appreciated by those skilled in the art that the marking and cutting device 1 can be utilized to mark or cut strips of selected width on or from a workpiece 43 such as sheetrock, gypsum board, formica and the like, by initially positioning the fulcrum 27 at the edge of the workpiece 43 with a portion of the flat base 13 of the tape housing 14 seated on the top surface of the workpiece 43 adjacent to the edge thereof such that the fulcrum 27 extends over the edge of the workpiece 43 as a guide. The extended tape segment 21 is then extended from the tape housing 14 a desired distance and either the pencil 44 or the knife blade handle 46 is mounted in the retainer 36, depending upon whether the workpiece 43 is to be marked for cutting using the pencil point 45 or cut directly, using the blade point 56 of the knife blade 52. The pencil 44 or retainer handle 47 is then extended along a line which is parallel to the edge of the workpiece 43 as the handle 2 and tape housing 14 is moved at the same rate along the edge of the workpiece 43, to either mark or cut the workpiece 43 along this line. Since the handle 2 is offset outwardly of the workpiece 43 from the centerline of the tape housing 15, the user's fingers and hand easily clear the edge of the workpiece 43, to avoid injury.

It will be appreciated by those skilled in the art that the marking and cutting device of this invention facilitates a compact, versatile, easily used device for inscribing and cutting straight lines, as well as various curved geometrical patterns, on workpieces of various description. For example, in addition to its application to the various crafts in the construction industry, the marking and cutting device can also be used for arts and crafts in such activites as marking and cutting construction paper and poster board, in non-exclusive particular. Furthermore, referring again to FIG. 2 of the drawing, the handle bore 7 of the handle 2 facilitates a means for storing spare pencils 44, knife blade handles 46 and knife blades 52 of various size, shape and description, as well as a scribing instrument such as a scratch awl shaft (not illustrated), in order to facilitate cuting and marking various materials. Furthermore, the pencils 44, knife blade handles 46 and knife blades 52 are easily retrieved from the handle bore 7 and replaced therein by removing and reinserting the threaded plug 9.

It will be further recognized that the marking and cutting device 1 can be constructed of substantially an desired material, including metal, plastic, fiberglass, wood and like materials, as desired. However, in a most preferred embodiment of the invention, the marking and cutting device 1 is injection-molded from a thermoplastic or thermoresin material according to the knowledge of those skilled in the art. Furthermore, it is understood that retaining means of substantially any selected design can be mounted on the tape end 35 of the extended tape segment 21, in order to removably secure the pencil 44 and the knife blade handle 46 therein. In like manner, closures other than the plug 9 may be used to removably close the handle bore 7 of the handle 2, further according to the knowledge of those skilled in the art.

Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A combination marking and cutting device for marking a workpiece, comprising a tape housing provided with a hollow tape housing interior; a fulcrum projecting from the bottom of said tape housing for rotating said handle and said tape housing about a vertical axis extending through said tape housing and said fulcrum; a spool rotatably mounted in said tape housing interior and a measuring tape wound on said spool, with one end of said measuring tape attached to said spool; a tape slot provided in said tape housing for receiving the opposite end of said measuring tape and unwinding said measuring tape from said spool; an elongated handle projecting from said tape housing in angular relationship away from said tape slot, said elongated handle having a projection on the free end thereof; a cavity provided in said elongated handle and removable closure means provided in said elongated handle for removably closing said cavity; and retaining means carried by said opposite end of said measuring tape outside of said tape housing, for receiving a pencil, whereby said measuring tape and said retaining means are extended from said tape slot to a selected length and said pencil and said handle are manipulated to mark the workpiece in a selected pattern.

2. The combination marking and cutting device of claim 1 further comprising lock means carried by said tape housing, said lock means extending through said tape housing and selectively engaging said measuring tape responsive to manipulation of said lock means, for preventing movement of said measuring tape with respect to said tape housing.

3. The combination marking and cutting device of claim 2 further comprising a flat base provided in said bottom of said tape housing an wherein said fulcrum projects from said flat base.

4. A combination marking and cutting device for cutting a workpiece, comprising a tape housing provided with a hollow tape housing interior; a fulcrum projecting from the bottom of said tape housing for rotating said handle and said tape housing about a vertical axis extending through said tape housing and said fulcrum; a spool rotatably mounted in said tape housing interior and a measuring tape wound on said spool, with one end of said measuring tape attached to said spool; a tape slot provided in said tape housing for receiving the opposite end of said measuring tape and unwinding said measuring tape from said spool; an elongated handle projecting from said tape housing in angular relationship away from said tape slot, said elongated handle having a projection on the free end thereof; a cavity provided in said elongated handle and removable closure means provided in said handle for removably closing said cavity; and retaining means carried by said opposite end of said measuring tape outside of said tape housing for receiving a knife blade, whereby said measuring tape and said retaining means are extended from said tape slot to a selected length and said knife blade and said handle are manipulated to cut the workpiece in a selected pattern.

5. The combination marking and cutting device of claim 4 further comprising lock means carried by said tape housing, said lock means extending through said tape housing and selectively engaging said measuring tape responsive to manipulation of said lock means, for preventing movement of said measuring tape with respect to said tape housing.

6. The combination marking and cutting device of claim 5 further comprising a flat base provided in said bottom of said tape housing and wherein said fulcrum projects from said flat base.

* * * * *